US007766523B2

(12) United States Patent
Kinoshita et al.

(10) Patent No.: US 7,766,523 B2
(45) Date of Patent: Aug. 3, 2010

(54) VEHICLE HEADLAMP

(75) Inventors: Masao Kinoshita, Shizuoka (JP); Akinori Matsumoto, Shizuoka (JP); Takehiko Tajima, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 187 days.

(21) Appl. No.: 11/790,163

(22) Filed: Apr. 24, 2007

(65) Prior Publication Data

US 2007/0247865 A1 Oct. 25, 2007

(30) Foreign Application Priority Data

Apr. 24, 2006 (JP) ..... 2006-119905

(51) Int. Cl.
*F21V 11/00* (2006.01)

(52) U.S. Cl. ..... 362/539; 362/284; 362/507; 362/512; 362/517; 362/538

(58) Field of Classification Search ..... 362/284, 362/507, 512, 513, 517, 518, 538, 539
See application file for complete search history.

(56) References Cited

U.S. PATENT DOCUMENTS

| | | | | |
|---|---|---|---|---|
| 6,286,985 | B1 * | 9/2001 | Ohshio et al. | 362/512 |
| 2003/0086277 | A1 * | 5/2003 | Hayakawa et al. | 362/513 |
| 2003/0090906 | A1 * | 5/2003 | Hayakawa | 362/517 |
| 2007/0069580 | A1 * | 3/2007 | Ohshio | 307/10.8 |

FOREIGN PATENT DOCUMENTS

JP 2003-297117 A 10/2003

* cited by examiner

*Primary Examiner*—Sandra L O'Shea
*Assistant Examiner*—Meghan K Dunwiddie
(74) *Attorney, Agent, or Firm*—Sughrue Mion, PLLC

(57) ABSTRACT

A lamp unit 18 is provided with a reflecting face 25*b* for an overhead sign and a light receiving face 28 for the overhead sign. The reflecting face 25*b* for an overhead sign reflects light from a light source 23*a* and is provided on an upper side of the light source 23*a* and rearward from a rear side focal point F of a projector lens 11. The light receiving face 28 for the overhead sign is provided on a front side of a movable shade 30 arranged between the projector lens 11 and the light source 23*a*. The light receiving face 28 forms overhead sign irradiating light P2 by reflecting light from the reflecting face 25*b* for the overhead sign to the projector lens 11. Illuminance reducer for reducing a portion of irradiating light is provided at a position of a vicinity of an upper end of the movable shade 30 of the light receiving face 28*a* for the overhead sign.

10 Claims, 11 Drawing Sheets

VEHICLE HEADLAMP

This application claims foreign priority from Japanese Patent Application No. 2006-119905, filed on Apr. 24, 2006, the entire contents of which are hereby incorporated by reference.

BACKGROUND OF THE INVENTION

1. Field of the Invention

The present invention relates to a projector type vehicle headlamp, particularly relates to a vehicle headlamp constituted to be able to irradiate an overhead sign (traffic sign).

2. Related Art

Generally, a vehicle headlamp of a projector type is constituted to reflect light from a light source arranged on an optical axis extended in a front and rear direction of a vehicle to a front side to be proximate to an optical axis by a reflector, and irradiate reflected light thereof to a front side of a lamp device by way of a projector lens provided on a front side of a reflector.

Further, when the vehicle headlamp of the projector type is constituted for irradiating a low beam (passing beam), the beam is irradiated to the front side by a low beam light distribution pattern having a predetermined cutoff line by providing a shade for removing irradiating light in an upward direction by blocking a portion of reflected light from a reflector between a projector lens and the reflector.

According to the headlamp of the projector type, the irradiating light in the upward direction is substantially completely removed by the shade, and therefore, an overhead sign (OHS) placed on an upper side of a road on a front side of a vehicle is not well seen.

Hence, in a background art, there is proposed a vehicle headlamp in which an opening portion is formed at a portion of a vicinity of an upper end edge of the shade, a rear face of the shade is provided with a light blocking plate in a shape of an eaves extended to a skewed lower side from between the upper end edge and the opening portion to a rear side. A portion of reflected light in an upward direction reflected by a lower reflecting region of the reflector is made to be incident on a projector lens by way of the opening portion to thereby provide overhead sign irradiating light for irradiating an overhead sign (refer to, for example, JP-A-2003-297117).

However, a light distribution pattern by the overhead sign irradiating light of JP-A-2003-297117 is determined by a contour shape of the opening portion formed at the portion at the vicinity of the upper end edge of the shade, the opening portion per se cannot adjust an intensity of transmitted light. Therefore, it is difficult to adjust an illuminance distribution at inside of the light distribution pattern. Particularly, it is extremely difficult to partially reduce an illuminance of a portion of a region at inside of the light distribution pattern even when a fine work is introduced to the shape of the opening portion.

Therefore, when there is brought about a request for forming a dark portion having an illuminance lower than that of a surrounding thereof of a portion in the light distribution pattern by the overhead sign irradiating light from, for example, a countermeasure against glare of a vehicle running on an opposed lane or laws or regulations or the like, it is difficult to deal therewith.

SUMMARY OF THE INVENTION

One or more embodiments of the invention provide a vehicle headlamp capable of easily adjusting an illuminance distribution in a light distribution pattern by overhead sign irradiating light, particularly capable of simply and firmly providing overhead sign irradiating light forming a dark portion having an illuminance lower than that of a surrounding thereof of a portion in the light distribution pattern in conformity with a countermeasure against glare of a vehicle running on an opposed lane or laws or regulations or the like.

In accordance with one or more embodiments of the present invention, a vehicle headlamp is provided with: a projector lens arranged on an optical axis extended in a front and rear direction of a vehicle; a light source arranged rearward from a rear side focal point of the projector lens; a reflector for reflecting direct light from the light source to a front side to be proximate to the optical axis; a shade arranged between the projector lens and the light source for forming a cutoff line of a light distribution pattern by blocking a portion of reflected light from the reflector and a portion of the direct light from the light source; a reflecting face for an overhead sign provided on an upper side of the light source for reflecting light from the light source; a light receiving face for the overhead sign provided frontward of the shade for reflecting light from the reflecting face for the overhead sign to the projector lens so as to emit irradiating light in an upward direction from the projector lens; and an illuminance reducer for reducing a portion of irradiating light by the light receiving face for the overhead sign, wherein the illuminance reducer is provided on the light receiving face for the overhead sign and in a position of a vicinity of an upper end of the shade.

According to the vehicle headlamp having the above-described constitution, a light flux reflected by the light receiving face for the overhead sign and incident on the projector lens as the light in the upward direction becomes the overhead sign irradiating light for irradiating the overhead sign. Further, at a region on the light receiving face for the overhead sign provided with the illuminance reducer, an emitted light amount is reduced more than that of a surrounding region. As a result, the illuminance is reduced at a position in correspondence with the illuminance reducer on the light distribution pattern by the overhead sign irradiating light, and a dark portion having an illuminance lower than that of a surrounding is formed.

Further, a position of the dark portion having the illuminance lower than that of the surrounding at inside of the light distribution pattern by the overhead sign irradiating light can simply be adjusted to an arbitrary position by arranging the illuminance reducer. Hence, there can simply and firmly be provided ideal overhead sign irradiating light forming the dark portion having the illuminance lower than that of the surrounding at a portion in the light distribution pattern in conformity with, for example, a countermeasure against glare of a vehicle running on an opposed lane or laws or regulations or the like.

Further, in the vehicle headlamp having the above-described constitution, the illuminance reducer may be constituted by a notch portion constituted by cutting a surface of the light receiving face for the overhead sign in a shape of a cylindrical face, and light reflected by the notch portion is not incident on the projector lens.

Although as a method of partially reducing the light amount reflected by the light receiving face for the overhead sign, it is conceivable to provide a raised portion for hampering light from being reflected to the side of the projection lens at a corresponding portion of the light receiving face for the overhead sign, in a case of a constitution of providing the raised portion as the illuminance reducer, there is a possibility that the raised portion blocks a portion of inherently distributed light passing through the upper end edge of the shade for irradiating a road face to thereby reduce a rate for utilizing the light flux.

However, in a case of constituting the illuminance reducer by the notch portion as in the vehicle headlamp having the above-described constitution, the portion of the inherently distributed light passing through the upper end edge of the shade for irradiating the road face is not blocked and the rate of utilizing the light flux can be prevented from being reduced.

Further, when the illuminance reducer is formed by the notch portion, a member for providing the light receiving face for the overhead sign is light-weighted by an amount of cutting the notch portion. Hence, when the member for providing the light receiving face for the overhead sign is integrated with the shade, light-weighted formation of the shade can be achieved.

Therefore, when the shade is made to be movable for switching the irradiation of the road face to a low beam and to a high beam, an operation for making the shade movable can be facilitated by reducing a load on an actuator for making the shade movable by the light-weighted formation of the shade.

Further, when the vehicle headlamp having the above-described constitution, the illuminance reducer may be constituted by a low reflecting portion constituted by making a reflectance of the surface of the light receiving face for the overhead sign lower than a reflectance of other portion.

According to the vehicle headlamp having such a constitution, for example, by constituting the low reflecting portion by a portion a reflecting face of which is roughened by drawing or the like, the illuminance reducer can further simply be formed.

Further, according to the vehicle headlamp having the above-described constitution, the illuminance reducer may be constituted by an opening portion constituted by cutting to raise the surface of the light receiving face for the overhead sign, and a front end of a cut-to-raise piece cut to raise is disposed at the vicinity of the upper end of the shade.

According to the vehicle headlamp having such a constitution, light incident on the opening portion formed by cutting to raise the surface is not reflected to the side of the projector lens, and therefore, at a position in correspondence with the opening portion of the light distribution pattern, the light amount is reduced to constitute the dark portion having the illuminance lower than that of the surrounding. Hence, there can be provided idea lover head sign irradiating light for forming the dark portion having the illuminance lower than that of the surrounding at a portion in the light distribution pattern in conformity with a countermeasure against glare of a vehicle running on an opposed lane or laws or regulations or the like.

Further, the front end of the cut-to raise piece disposed at the vicinity of the upper end of the shade blocks a portion of inherently distributed light passing through the upper end edge of the shade for irradiating the road face to thereby form the dark portion the illuminance of which is lower than that of the surrounding (illuminance reduced region) at the corresponding position of the light distribution pattern on the road face.

Therefore, not only the dark portion having the illuminance lower than that of the surrounding is formed at an arbitrary position in the light distribution pattern by the overhead sign irradiating light, but also a portion of the light distribution pattern by the road face irradiating light can be formed with the dark portion smoothly reducing the illuminance, and a high degree of light distribution pattern in conformity with a countermeasure against glare of a vehicle running on an opposed lane or laws or regulations or the like can easily be formed.

Further, according to the vehicle headlamp having the above-described constitution, the light receiving face for the overhead sign on a lower side of the illuminance reducer may be provided with an additional illuminance reducer for reducing a portion of irradiating light by the light receiving face for the overhead sign.

According to the vehicle headlamp having such a constitution, other than the dark portion by the illuminance reducer, a dark portion by the additional illuminance reducer is added on the light distribution pattern by the overhead sign irradiating light.

Hence, when, for example, a member for providing the light receiving face for the overhead sign is integrated to the shade, the shade is constituted to be movable such that the irradiation of the road face can be switched to a low beam and to a high beam, by a failsafe operation of moving down the optical axis after horizontally rotating the lamp unit by a swivel mechanism, the position of the dark portion by the illuminance reducer is shifted from the position of the vehicle running on the opposed lane, by setting to constitute the position of the vehicle running on the opposed lane by a position of a dark portion by the additional illuminance reducer in place thereof, compliance with laws and regulations for regulating a glare from being brought about can be promoted without losing the countermeasure against glare of the vehicle running on the opposed lane in a failsafe operation.

According to the vehicle headlamp of one or more embodiments of the invention, the overhead sign irradiating light can be formed by reflection at the light receiving face for the overhead sign, and by adjusting the position of mounting the illuminance reducer on the light receiving face for the overhead sign, the dark portion having the illuminance lower than that of the surrounding can be formed at an arbitrary position in the light distribution pattern by the overhead sign irradiating light. Hence, ideal overhead sign irradiating light for forming the dark portion having the illuminance lower than that of the surrounding can simply and firmly be provided at a portion of the light distribution pattern in conformity with a countermeasure against glare of the vehicle running on the opposed lane or laws or regulations or the like.

Other aspects and advantages of the invention will be apparent from the following description and the appended claims.

DETAILED DESCRIPTION OF THE EXEMPLARY EMBODIMENTS

Exemplary embodiments of the invention will be described with reference to the accompanying drawings.

Figure 1:
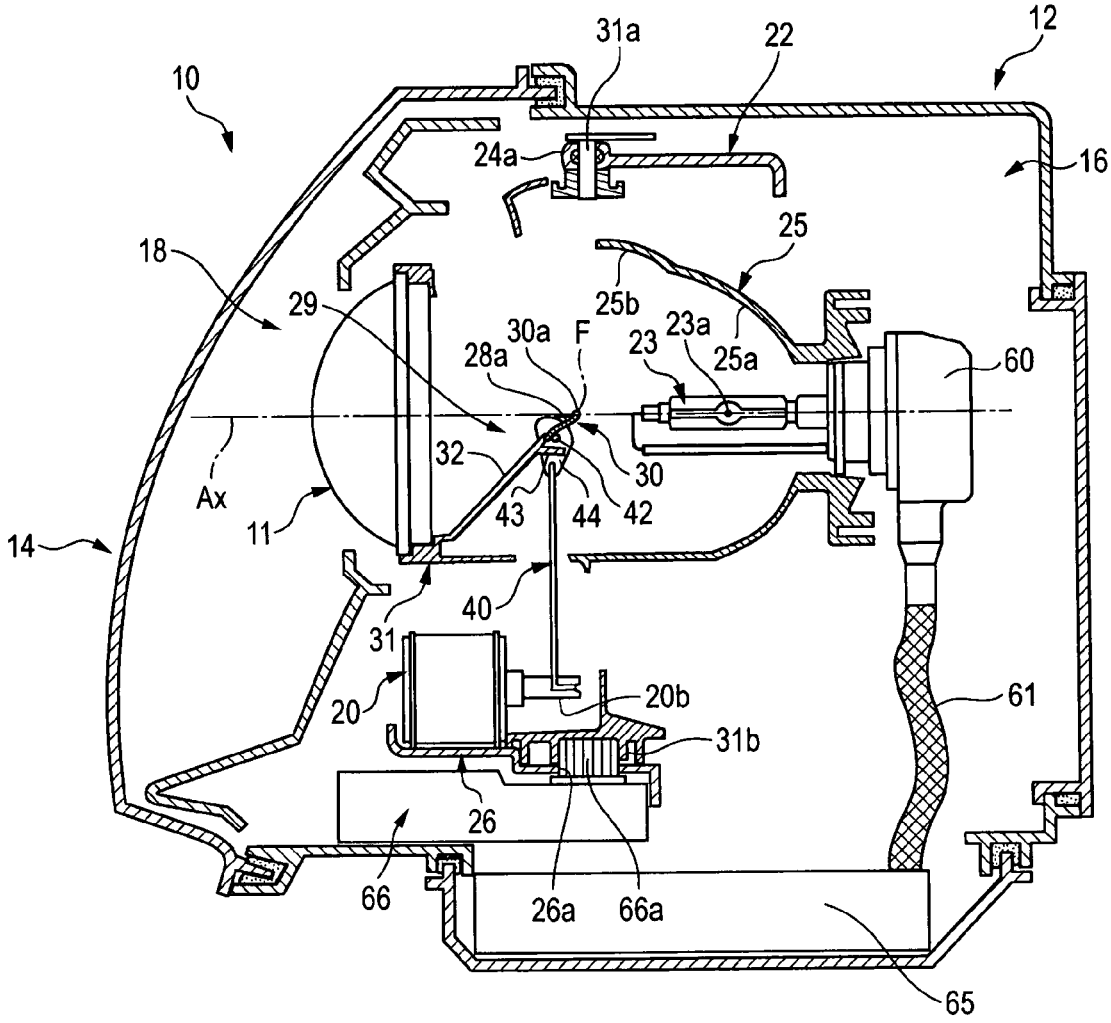
FIG. 1 is a vertical sectional view of a vehicle headlamp according to a first exemplary embodiment of the invention.
Figure 2:
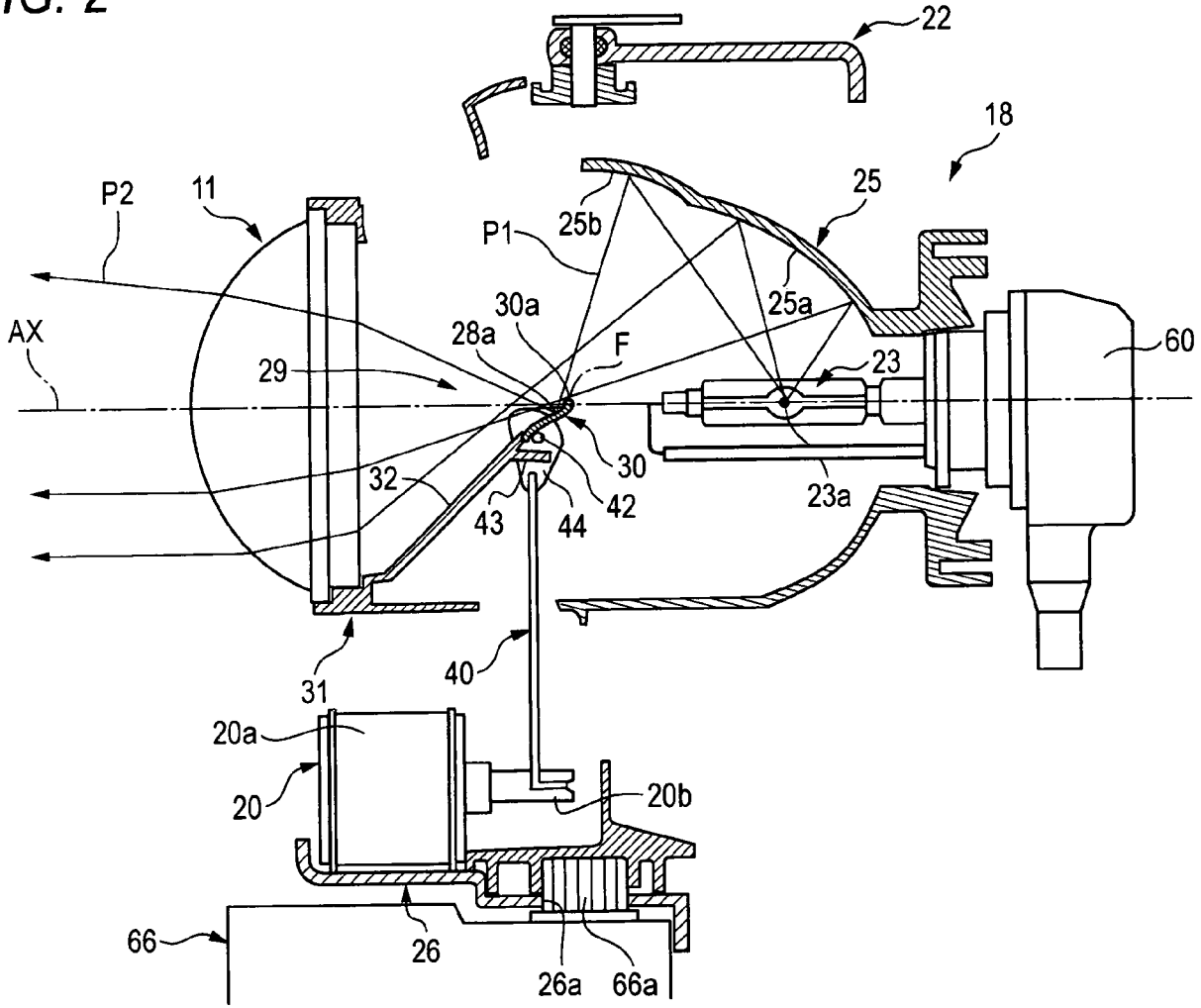
FIG. 2 is an explanatory view of an operation when a movable shade is disposed at a blocking position in a lamp unit shown in FIG. 1.
Figure 3:
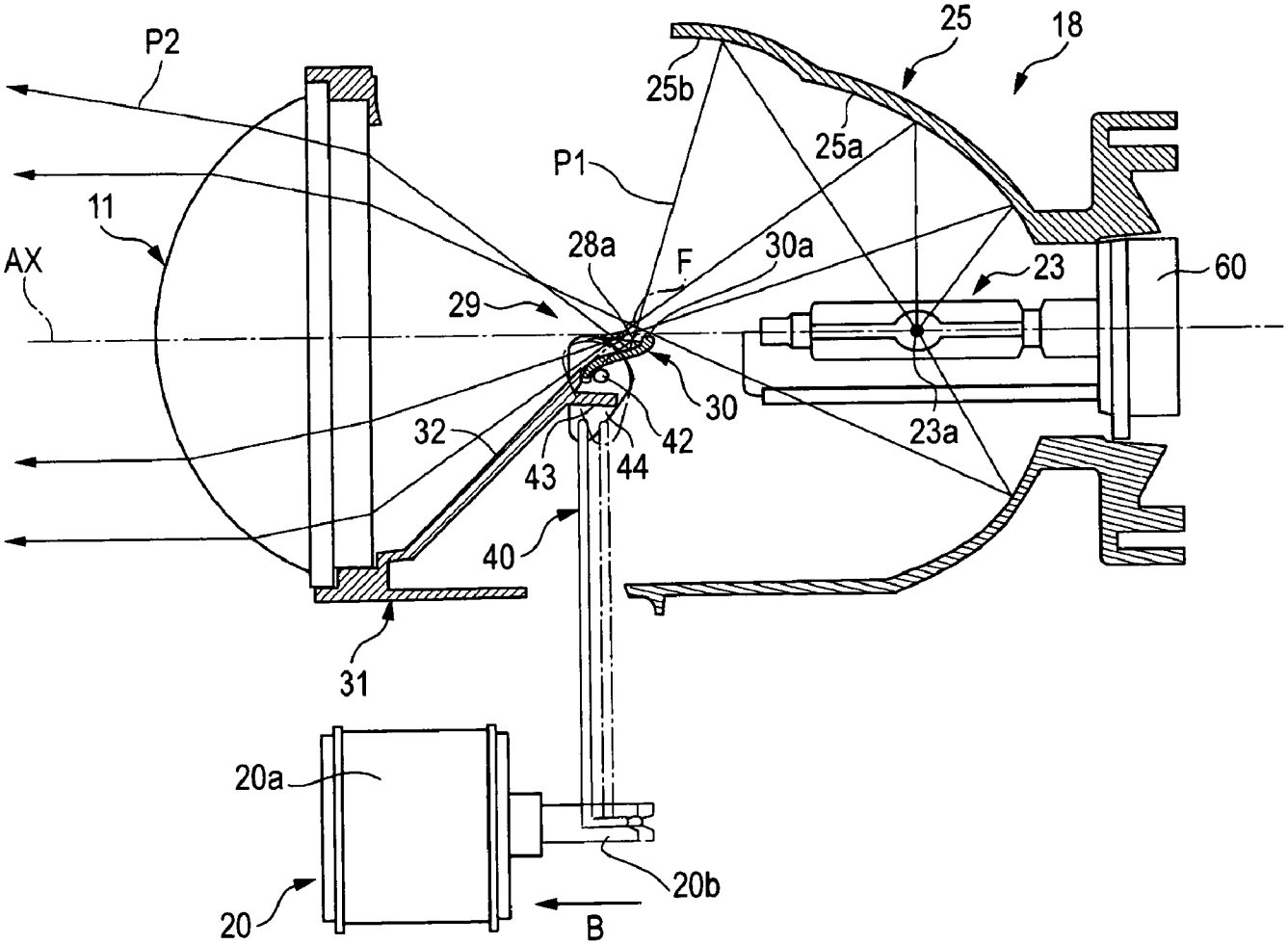
FIG. 3 is an explanatory view of an operation when the movable shade is disposed at a block alleviating position in the lamp unit shown in FIG. 1.
Figure 4:
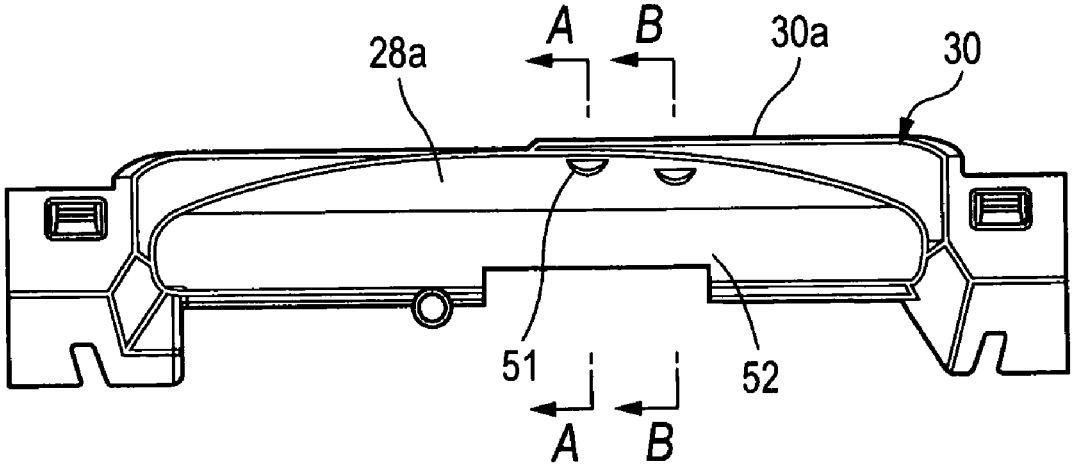
FIGS. 4(*a*) and 4(*b*) illustrate explanatory views of a light receiving face for an overhead sign arranged on a front side of the movable shade of the lamp unit shown in FIG. 1, FIG. 4(*a*) is a front view of the light receiving face for the overhead sign, and FIG. 4(*b*) is a plane view thereof.
Figure 4:
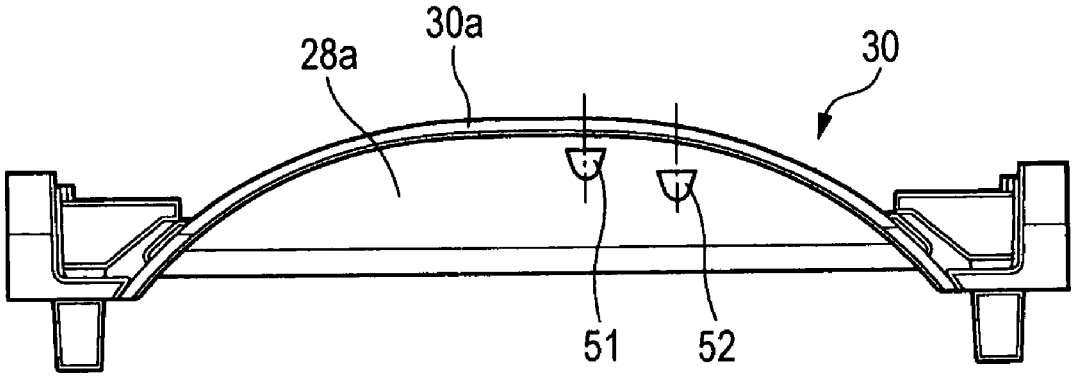
Figure 5:
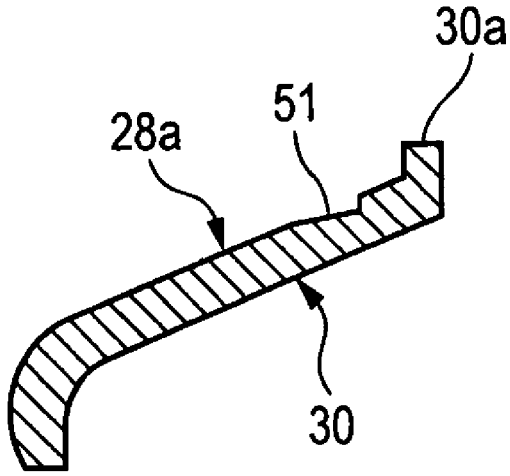
FIG. 5(*a*) is a sectional view taken along a line A-A of FIG. 4(*a*), and FIG. 5(*b*) is a sectional view taken along a line B-B of FIG. 4(*a*).
Figure 5:
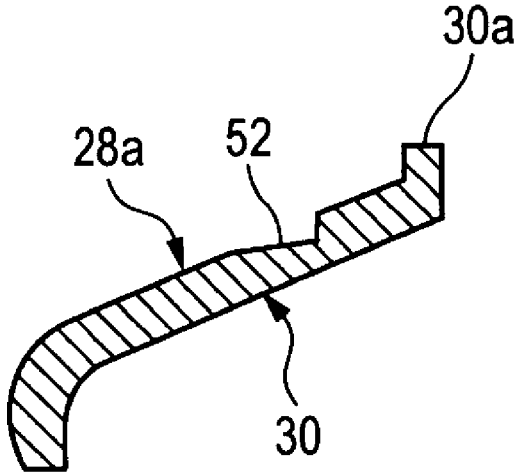

FIG. 1 is a vertical sectional view of a vehicle headlamp according to a first exemplary embodiment of the invention. FIG. 2 is an explanatory view of an operation when a movable shade is disposed at a blocking position in a lamp unit shown in FIG. 1. FIG. 3 is an explanatory view of an operation when the movable shade is disposed at a block alleviating position in the lamp unit shown in FIG. 1. FIGS. 4(*a*) and 4(*b*) are explanatory views of a light receiving face for an overhead sign in which the movable shade of the lamp unit shown in FIG. 1 is arranged on a front side, FIG. 4(*a*) is a front view of the light receiving face for the overhead sign, and FIG. 4(*b*) is a plane view thereof. FIG. 5(*a*) is a sectional view taken along a line A-A of FIG. 4(*a*). FIG. 5(*b*) is a sectional view taken along a line B-B of FIG. 4(*a*).

According to a vehicle headlamp 10 of the first exemplary embodiment, as shown by FIG. 1, a lamp unit 18 is contained at inside of a lamp chamber 16 formed by a lamp body 12 and a transparent cover (cover) 14 in a transparent state attached to a front opening portion thereof.

As shown by FIG. 1, the lamp unit 18 is supported by the lamp body 12 by way of a frame 22. The frame 22 is supported by the lamp body 12 by way of an aiming mechanism, not illustrated.

The aiming mechanism is a mechanism for finely adjusting an attaching position and an attaching angle of the lamp unit 18. At a stage of adjusting aiming, a lens center axis Ax of the lamp unit 18 is extended in a direction downward by about 0.5 through 0.6 degree relative to a front and rear direction of a vehicle.

The frame 22 is constituted by a shape of substantially a rectangular frame in view from a front side and is provided with support plates 24, 26 extended in the front and rear direction on upper and lower sides. A front end portion of the support plate 24 on the upper side is provided with a bearing portion 24*a* A supported shaft 31*a* provided at an upper portion of the lamp unit 18 is rotatably supported by the bearing portion 24*a*. The support plate 26 on the lower side is formed with a shaft inserting hole 26*a* in a circular shape at a portion of a rear end portion of the support plate 26 disposed right below the bearing portion 24*a*. Further, a lower face of the support plate 26 on the lower side of the frame 22 is fixed with a swivel actuator 66 for pivoting the lamp unit 18 in a horizontal direction.

According to the swivel actuator 66 constituting a swivel mechanism, for example, an output shaft 66*a* is rotated by being driven in accordance with a steering operation. The output shaft 66*a* is inserted into the shaft inserting hole 26*a* of the support plate 26, fitted to a connecting shaft 31*b* provided at a lower portion of the lamp unit 18, and the connecting shaft 31*b* is connected to the output shaft 66*a*.

Therefore, when the swivel actuator 66 is driven, the output shaft 66*a* is rotated, and the lamp unit 18 is pivoted in the horizontal direction in accordance with rotation of the output shaft 66*a*.

As shown by FIG. 1 and FIG. 2, the lamp unit 18 is a lamp unit of a projector type including a projector lens 11 arranged on the lens center axis (optical axis) Ax extended in the front and rear direction of the vehicle, a light source bulb 23 arranged rearward from a rear side focal point F of the projector lens 11, a reflector 25 constituting a first focal point thereof by a light source 23*a* of the light source bulb 23 for reflecting light (direct light) irradiated from the light source bulb 23 to a front side to be proximate to the lens center axis Ax, a shade mechanism 29 arranged between the projector lens 11 and the light source 23*a* for forming a cutoff line of a light distribution pattern by blocking a portion of reflected light from the reflector 25 and a portion of direct light from the light source 23*a*, a holder 31 substantially in a cylindrical shape interposed between the projector lens 11 and a front end opening edge of the reflector 25 and constituting connecting means of the both members, a reflecting face 25*b* for an overhead sign provided between the reflector 25 and the projector lens 11 on an upper side of the light source 23*a* for reflecting light from the light source 23*a* to a position slightly frontward from the rear side focal point F, a light receiving face 28*a* for the overhead sign provided on a front side of the movable shade 30 for reflecting light P1 from the reflecting plate 25*b* for the overhead sign to the projector lens 11, and emitting overhead sign irradiating light P2 constituting irradiating light in an upward direction from the projector lens 11.

The shade mechanism 29 enables to selectively switch distributed light for irradiating a low beam (passing beam) or for a high beam in accordance with a situation of running the vehicle or the like. The shade mechanism 29 is constituted by a movable shade 30 arranged between the projector lens 11 and the light source 23*a* such that an upper end edge 30*a*is disposed at a vicinity of the lens center axis Ax at a vicinity of the rear side focal point F of the projector lens 11 for forming a cutoff line of a light distribution pattern by blocking a portion of reflected light from the reflector 25 and a portion of direct light of the light source 23*a*, a fixed shade 32 arranged at an inner space of the holder 31, a rod member 40 and an actuator 20 for making the movable shade 30 carry out a pivoting operation.

The projector lens 11 comprises a flat convex lens having a front side surface in a convex face and a rear side surface in a flat face for projecting an image in a shape of a focal face including the rear side focal point F to a front side as an inverted image.

The light source bulb 23 is a discharge bulb of a metal halide bulb or the like constituting a discharge light emitting portion by the light source 23*a*, and is inserted to be fixed to a rear end portion of the reflector 25 constituting a bulb axis by a direction coinciding with the lens center axis Ax in the case of the embodiment.

The light source bulb 23 is attached with a bulb socket 60. Further, a power feed cord 61 led out from the bulb socket 60 is extended to a lower side by passing a back side of the lamp unit 18, and connected to a lighting circuit unit 65 arranged at a lower portion of the lamp body 12, thereby, a lighting voltage and a starting voltage are supplied from a discharge lighting circuit provided to the lighting circuit unit 65 to the light source bulb 23.

Further, a halogen bulb or the like can also be used in place of the discharge bulb, or the light source bulb 23 can be inserted to fix from a side direction of the reflector 25 in a direction of substantially intersecting the bulb shaft to the lens center axis Ax.

Here, although the conception of the 'direction substantially intersecting with the lens center axis Ax' naturally includes a case of arranging the optical axis of the light source bulb 23 orthogonally to the lens center axis Ax extended in the front and rear direction of the vehicle, the conception also includes a case of arranging the optical axis to be three-dimensionally intersecting with the lens center axis Ax, a case of arranging the optical axis in a state of being inclined to a horizontal line in a width direction of the vehicle by about ±15°.

The reflector 25 includes a reflecting face 25*a* in a shape of an ellipsoid constituting a center axis thereof by the lens center axis Ax passing the light source 23*a*.

The reflecting face 25*a* is set to substantially ellipsoidal sectional shape including the lens center axis Ax of which constitutes a first focal point by a position of a center of the light source 23*a* and constitutes a second focal point by a vicinity of the rear side focal point F of the projector lens 11 for condensing and reflecting light from the light source 23*a* to a front side to be proximate to the lens center axis Ax. Further, an eccentricity of the reflecting face 25*a* is set to be gradually increased from a vertical section to a horizontal section.

The reflecting plate 25*b* for the overhead sign is integrally formed with the reflector 25 as a reflecting face continuous to an end portion of the reflecting face 25*a* of the reflector 25.

Hence, a formed part can be simplified by forming the reflecting plate 25*b* for the overhead sign integrally with the reflector 25.

The reflecting plate 25*b* for the overhead sign is set to substantially an ellipsoid a sectional shape including the lens center axis Ax of which constitutes a first focal point by the position of the center of the light source 23*a* and constitutes a second focal point by a vicinity of a center of the light receiving face 28*a* for the overhead sign disposed slightly frontward from the rear side focal point F of the projector lens 11 for condensing and reflecting light from the light source 23*a* to the light receiving face 28*a* for the overhead sign. Further, an eccentricity of the reflecting plate 25*b* for the overhead sign is set to gradually increase from a vertical section to a horizontal section.

The light receiving face 28*a* for the overhead sign is a reflecting face formed integrally with a front face of the movable shade 30. The light receiving face 28*a* for the overhead sign is formed by substantially a parabolaid of revolution constituting a center axis by a line segment extended from the second focal point of the reflecting plate 25*b* for the overhead sign in a front upward direction and constituting a focal point thereof by the second focal point of the reflecting plate 25*b* for the overhead sign, and light incident on the light receiving face 28*a* for the overhead sign from the reflecting plate 25*b* for the overhead sign is incident on the projector lens 11 as parallel light irradiated in an upper direction.

The holder 31 includes a rear end portion in a shape of a semicircular arc fixedly supported by a front end opening portion of the reflector 25, a front end portion in a shape of a circular ring for fixedly supporting the projector lens 11, and a plurality of connecting ribs connecting these.

The fixed shade 32 is a shade for preventing stray light reflected by the reflector 25 incident on the projector lens 11 and is formed integrally with the holder 31.

The movable shade 30 is a die cast product and is provided to be disposed at a lower vicinity of the lens center axis Ax in the inner space of the holder 31, and is supported pivotably around a rotating shaft 42 extended in a vehicle width direction. The rotating shaft 42 is rotatably supported by a support portion 43 integrally formed with a back face of the fixed shade 32, although not illustrated.

An end portion of the movable shade 30 is fixedly mounted with a cam plate 44 integrally rotated with the movable shade 30 around the rotating shaft 42. The cam plate 44 is connected with one end of the rod member 40. Other end of the rod member 40 is connected to a plunger 20*b* constituting an output shaft of the actuator 20.

The actuator 20 is a solenoid for driving to extract and retract the plunger 20*b* contained in a main body 20*a*thereof in a direction in parallel with the lens center axis Ax relative to the main body 20*a*fixed to the support plate 26, and is operated when a beam switching switch, not illustrated, is operated for switching a position of the movable shade 30 by pivoting the cam plate 44 around the rotating shaft 42 by moving the rod member 40 in accordance with extracting and retracting operation of the plunger 20*b*.

When the beam switching switch is set to a position of selecting a low beam, the plunger 20*b* of the actuator 20 is brought into a state of being maximally projected from the main body 20*a*as shown by FIG. 1 and FIG. 2, at this occasion, the movable shade 30 is held at a blocking position shown in FIG. 2.

Further, the rotating shaft 42 is mounted with a return spring (not illustrated) by a torsional coil spring for urging the movable shade 30 to a side of the blocking position.

On the other hand, when the beam switching switch is set to a position of selecting a high beam, as shown by an arrow mark B in FIG. 3, the plunger 20*b* of the actuator 20 is drawn into the main body 20*a*by a predetermined amount from the state of being maximally projected from the main body 20*a*. Thereby, the rod member 40 is displaced from a position indicated by a one-dotted chain line in FIG. 3 to a position indicated by a bold line, by pivoting the cam plate 44 following the displacement of the rod member 40, the movable shade 30 is moved from the blocking position to a block alleviating position (position indicated by bold line in FIG. 3) pivoted from the blocking position to a rear side by a predetermined angle.

Further, when the beam switching switch is switched from the position of selecting a high beam to a position of selecting a low beam, by an urge force of the return spring mounted to the rotating shaft 42, the cam plate is pivoted in the original direction, the plunger 20*b* of the actuator 20 is returned to an original projected amount, and the movable shade 30 returns to the blocking position.

As shown by FIGS. 4(*a*) and 4(*b*), the upper end edge 30*a* of the movable shade 30 is formed by a stepped difference in a left and right direction, and is formed to extend by being bent substantially in the circular arc shape in the horizontal direction along a rear side focal face of the projector lens 11 when the movable shade 30 is disposed at the blocking position.

Further, as described above, a front face of the movable shade 30 is formed with the light receiving face for the overhead sign, as shown by FIGS. 4(*a*), 4(*b*), 5(*a*), and 5(*b*), a position of a vicinity of an upper end of the movable shade 30 of the light receiving face 28*a* for the overhead sign is provided with an illuminance reducer 51 for reducing a portion of irradiating light by the light receiving face 28*a* for the overhead sign.

Further, according to the embodiment, an additional illuminance reducer 52 for reducing a portion of irradiating light by the light receiving face 28*a* for the overhead sign is provided on the light receiving face 28*a* for the overhead sign on the lower side of the illuminance reducer 51.

In the case of the embodiment, the illuminance reducer 51 and the additional illuminance reducer 52 are constituted by notch portions constituted by cutting the surface of the light receiving face 28*a* for the overhead sign in a shape of a cylindrical face, light reflected by the notch portion is not incident on the projector lens 11.

Next, a light distribution by the vehicle headlamp 10 will be explained.

Figure 6:
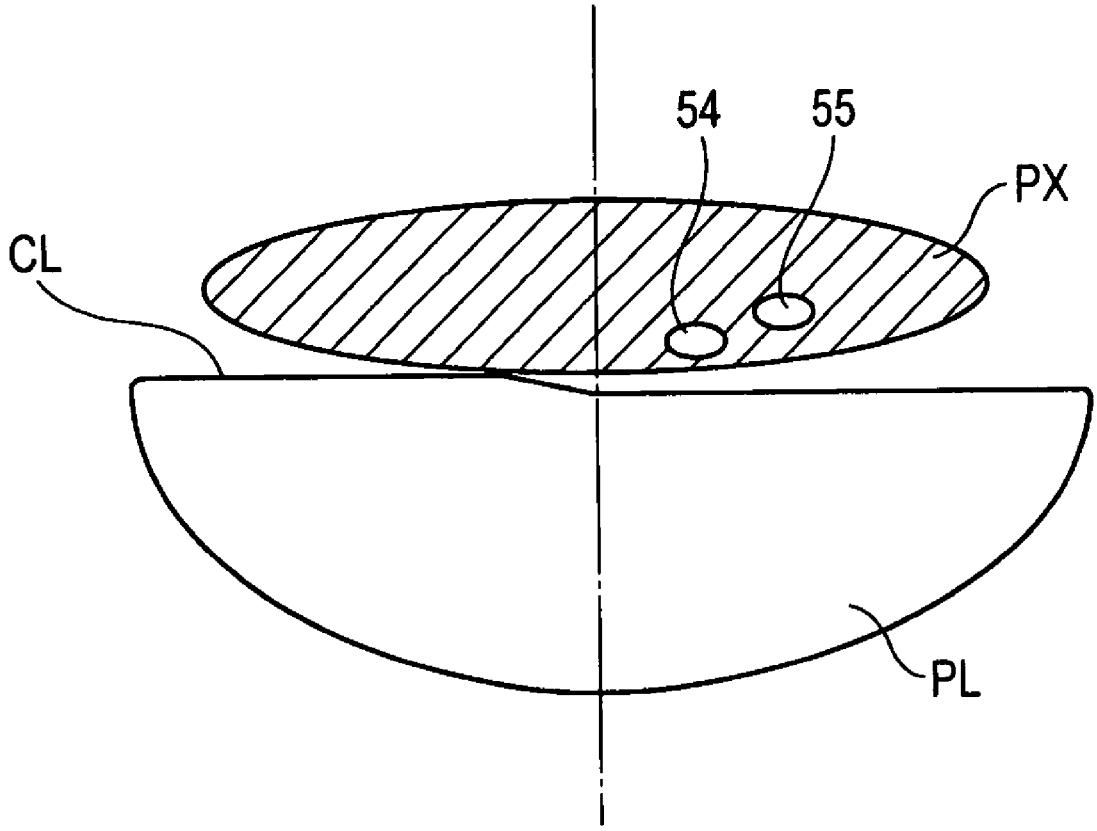
FIG. 6 is a view perceptively showing a light distribution pattern for a high beam formed on an imaginary vertical screen disposed at a position frontward from the lamp device by 25 m by light irradiated to a front side by a lamp unit when the movable shade of the lamp unit shown in FIG. 1 is disposed at the blocking position.

As shown by FIG. 2, when the movable shade 30 is disposed at the blocking position, the shade mechanism 29 having the movable shade 30 and the fixed shade 32 forms a light distribution pattern PL for a low beam for left side passing having a so-to-speak Z type cutoff line CL having a stepped difference in a left and right direction as shown by FIG. 6.

Reflected light P1 from the reflecting plate 25*b* for the overhead sign is incident on the projector lens 11 as light in an upper direction by the light receiving face 28*a* for the overhead sign, emitted as overhead sign irradiating light P2 from the projector lens 11, and forms an OHS light distribution pattern PX for irradiating the overhead sign on an upper side of the light distribution pattern PL for a low beam.

The OHS light distribution pattern PX forms an irradiating region in a shape of an ellipse a long axis of which is extended in the vehicle width direction, and inside of the distributed light is formed with dark portions 54, 55 in a spot-like shape the illuminance of which are reduced more than that of surrounding by the illuminance reducer 51 and the additional illuminance reducer 52.

According to the dark portion 54, there is formed a dark portion having an illuminance lower than that of a surrounding thereof at a portion in the light distribution pattern PX in conformity with a countermeasure against glare of a vehicle running on an opposed lane or laws or regulations or the like.

According to the vehicle headlamp 10 of the embodiment explained above, the light flux reflected by the light receiving face 28*a* for the overhead sign and incident on the projector lens 11 as light in the upper direction becomes overhead sign irradiating light P2 for irradiating the overhead sign.

Further, at a region of providing the illuminance reducer 51 on the light receiving face 28*a* for the overhead sign, an emitted light amount is reduced more than that of the region of the surrounding. As a result, the illuminance is reduced at the position in correspondence with the illuminance reducer 51 on the light distribution pattern PX by the overhead sign irradiating light P2, and the dark portion 54 having the illuminance lower than that of the surrounding is formed.

Further, the position of the dark portion 54 having the illuminance lower than that of the surrounding in the light distribution pattern PX by the overhead sign irradiating light P2 can simply be adjusted to an arbitrary position by adjusting a position of mounting the illuminance reducer 51.

Hence, there can simply and firmly be provided ideal overhead sign irradiating light P2 for forming the dark portion having an illuminance lower than that of the surrounding at a portion of the light distribution pattern PX in conformity with a countermeasure against glare of a vehicle running on an opposed lane or laws or regulations or the like.

Further, as a method of partially reducing the light amount reflected by the light receiving face 28*a* for the overhead sign, it is conceivable to provide a raised portion for hampering light from being reflected to the side of the projector lens 11 at a corresponding portion of the light receiving face 28*a* for the overhead sign, in a case of a constitution of providing the raised portion as the illuminance reducer 51, there is a possibility of reducing a rate of utilizing the light flux by blocking a portion of original distributed light passing the upper end edge of the movable shade 30 for illuminating a road face by the raised portion.

Hence, when the illuminance reducer 51 is constituted by the notch portion as in the embodiment, for example, a portion of original distributed light passing the upper end edge 30*a* of the movable shade 30 for illuminating a road face is not blocked and the rate of utilizing the light flux can be prevented from being reduced.

Further, when the illuminance reducer 51 is formed by the notch portion as in the embodiment, light-weighted formation of the movable shade 30 constituting a member of providing the light receiving face 28*a* for the overhead sign can be achieved by an amount of cutting the notch portion.

Hence, by light-weighted formation of the movable shade 30 for switching irradiation of a road face to a low beam or to a high beam, the movable operation of the movable shade 30 can be facilitated by alleviating a load on the actuator 20 for making the movable shade 30 movable.

Next, an explanation will be given of distributed light when a failsafe operation of moving down the optical axis is carried out after horizontally rotating the lamp unit 18 by the swivel actuator 66 by a predetermined angle.

According to the vehicle headlamp 10 of the embodiment, when the failsafe operation is carried out by a failure or the like of the swivel mechanism, the optical axis of the lamp unit 18 is moved down after horizontal rotation by the swivel actuator 66.

Figure 7:
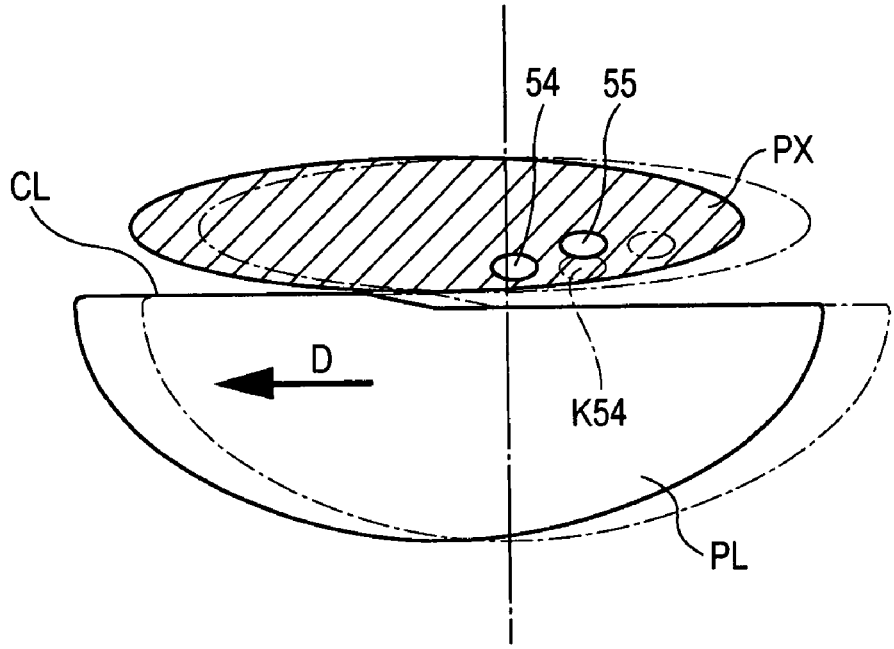
FIG. 7(*a*) is an explanatory view for moving a light distribution pattern to the left by swiveling the lamp unit shown in FIG. 1, and FIG. 7(*b*) is an explanatory view of moving the light distribution pattern to a lower side by moving down an optical axis after a failsafe operation of the lamp unit.
Figure 7:
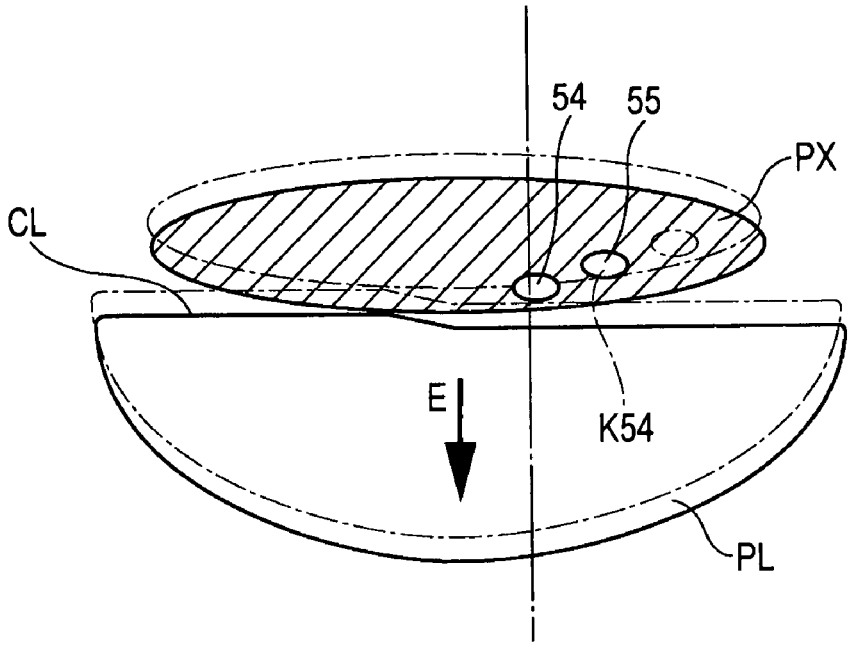

Hence, irradiating regions by the respective light distribution patterns PL, PX are horizontally moved in a left direction indicated by a narrow mark D in FIG. 7(*a*) and thereafter moved in parallel to a lower side indicated by an arrow mark E in FIG. 7(*b*).

That is, by horizontally moving the respective light distribution patterns PL, PX in the left direction by the fail safe operation, the dark portion 55 formed by the additional illuminance reducer 52 is moved right above a position (assumed position K54) of the dark portion 54 formed by the illuminance reducer 51 before the swivel operation. Further, by moving the respective light distribution patterns PL, PX to the lower side in parallel with each other, the dark portion 55 overlaps the position (assumed position K54) of the dark portion 54 formed by the illuminance reducer 51 before the swivel operation.

Therefore, when the lamp unit 18 carries out the failsafe operation, the dark portion 55 formed by the additional illuminance reducer 52 is moved to the dark portion 54 formed by the illuminance reducer 51 to maintain a function for a countermeasure against glare of a vehicle running on an opposed lane. Therefore, compliance of laws and regulations for regulating glare from being brought about can be promoted without losing the countermeasure against glare of the vehicle running on the opposed lane in the failsafe operation.

Further, specific structures of the illuminance reducer 51 and the additional illuminance reducer 52 mounted to the light receiving face 28*a* for the overhead sign according to the invention are not limited to the notch portion in the shape of the cylindrical face according to the first embodiment.

Figure 8:
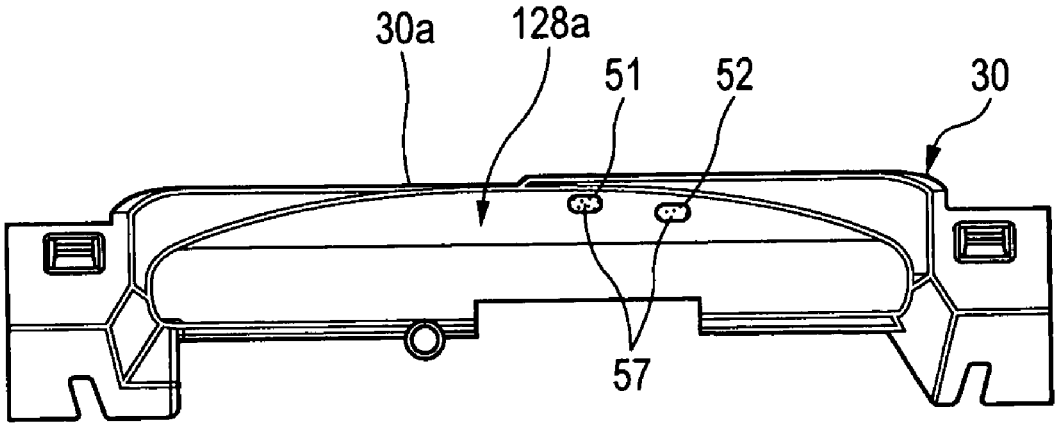
FIGS. 8(*a*) and 8(*b*) illustrate explanatory views of a light receiving face for an overhead sign according to other embodiment of the invention, FIG. 8(*a*) is a front view of the light receiving face for the overhead sign, and FIG. 8(*b*) is a plane view thereof.
Figure 8:
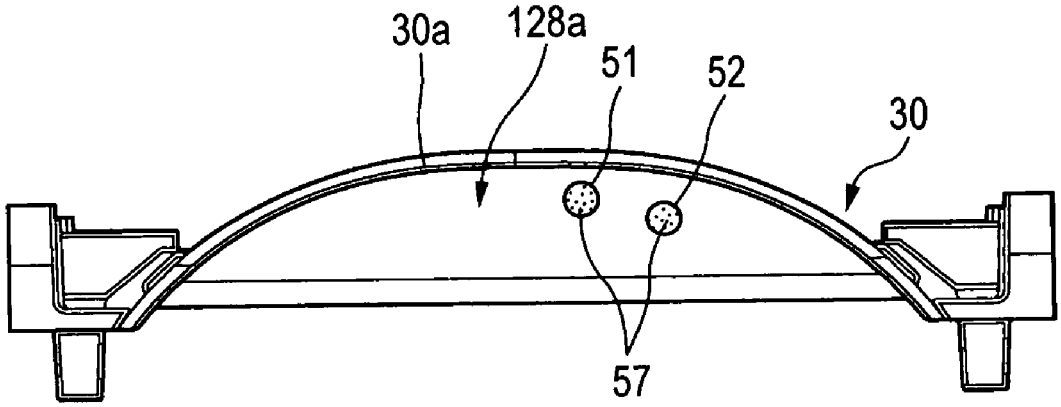

For example, as shown by FIGS. 8(*a*) and 8(*b*), the illuminance reducer 51 and the additional illuminance reducer 52 may be constituted by a low reflecting portion 57 by which a surface of the light receiving face 28*a* for the overhead sign is constituted by a reflectance lower than that of other portion.

The low reflecting portion 57 is a portion of roughening the reflecting face by, for example, drawing or the like, when such a constitution is constructed, the illuminance reducer 51 and the additional illuminance reducer 52 can further simply be formed.

Further, according to the embodiment, the reflecting face 25*b* for the overhead sign of the additional reflector is constituted by the reflecting face continuous to the end of the reflecting face 25*a* of the reflector 25. However, a constitution shown by FIG. 9 can be constructed.

Figure 9:
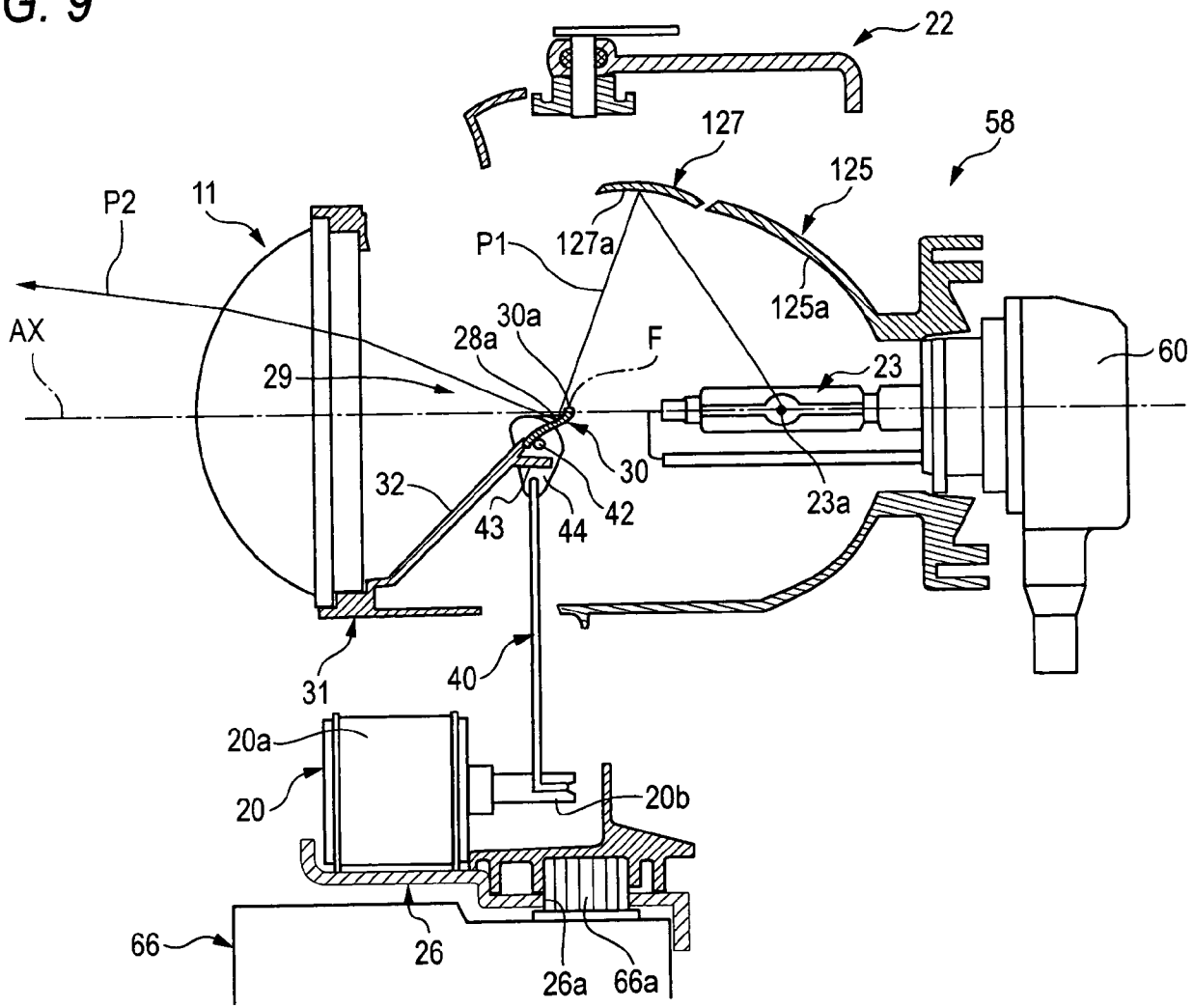
FIG. 9 is a vertical sectional view of a lamp unit according to a second exemplary embodiment of the invention.

FIG. 9 is a vertical sectional view of a lamp unit according to a second exemplary embodiment of the invention. Further, a lamp unit 58 shown in FIG. 9 is common to the lamp unit 18 of the first exemplary embodiment except a point that a reflecting face 127*a* for an overhead sign is constituted by an independent reflecting face provided from a reflecting face 125*a* of a reflector 125, common constitutions are attached with common notations and an explanation thereof will be omitted.

According to the lamp unit 58 of the second exemplary embodiment, the reflecting face 127*a* for the overhead sign is a reflecting face formed at an inner face of the reflector 127 formed separately from the reflector 125.

Further, according to the first and the second exemplary embodiments, the shade mechanism 29 is provided with the movable shade 30, and the front face per se of the movable shade 30 is formed into the light receiving face 28*a* for the overhead sign.

However, a mode of mounting the light receiving face for the overhead sign according to the invention is not limited to the structure shown in the above-described exemplary embodiments.

Figure 10:
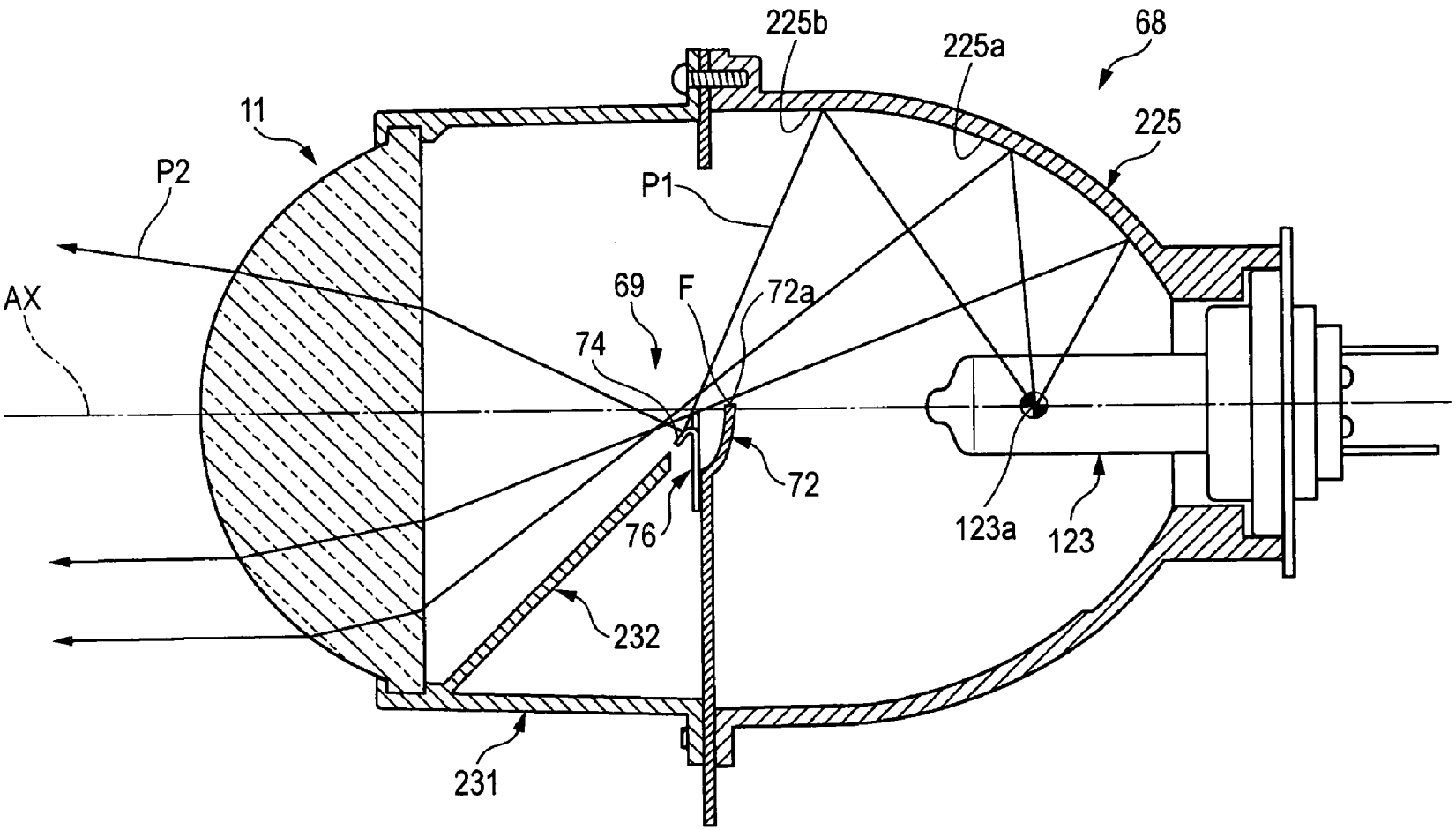
FIG. 10 is a sectional view of a lamp unit according to a third exemplary embodiment of the invention.
Figure 11:
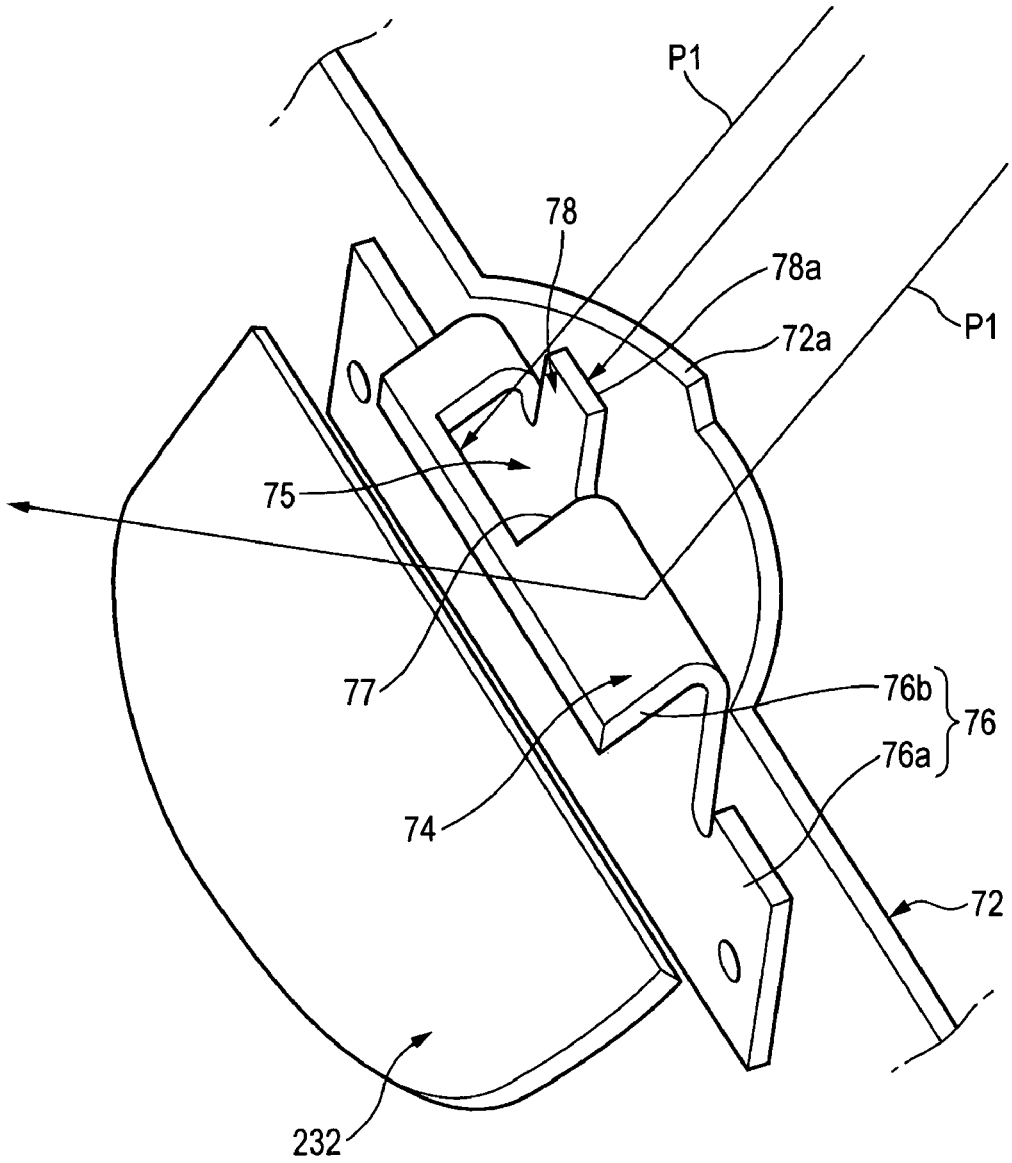
FIG. 11 is a perspective view enlarging a vicinity of a light receiving face for an overhead sign of the lamp unit shown in FIG. 10.

FIG. 10 is a vertical sectional view of a lamp unit according to a third exemplary embodiment of the invention, FIG. 11 is a perspective view enlarging a vicinity of a light receiving face for an overhead sign of the lamp unit shown in FIG. 10.

A lamp unit 68 shown in the third exemplary embodiment is contained in a lamp chamber formed by a lamp body and a transparent cover similar to the lamp unit 18 shown in the first exemplary embodiment although not illustrated.

As shown by FIG. 10, the lamp unit 68 of the third exemplary embodiment includes the projector lens 11 arranged on the lens center axis (optical axis) Ax extended in a front and rear direction of the vehicle, a light source bulb 123 arranged rearward from the rear side focal point of the projector lens 11, a reflector 225 for reflecting direct light from a light source 123*a* of the light source bulb 123 to a front side to be proximate to the optical axis Ax, a shade mechanism 69 arranged between the projector lens 11 and the light source 123*a* for forming a cutoff line of a light distribution pattern by blocking a portion of reflected light from the reflector 125 and a portion of direct light from the light source 123*a*, a reflecting face 225*b* for an overhead sign provided on an upper side of the light source 123*a* for reflecting light from the light source 123*a* to be proximate to the lens center axis Ax frontward from the rear side focal point F, and a light receiving face 74 for an overhead sign provided on a front side of a first fixed shade 72 constituting the shade mechanism 69 for reflecting light P1 from the reflecting face 225*b* for the overhead sign to the projector lens 11 and emitting overhead sign irradiating light P2 constituting irradiating light in an upward direction from the projector lens 11.

Further, a position of a vicinity of an upper end of the first fixed shade 72 of the light receiving face 74 for the overhead sign is provided with illuminance reducer 75 for reducing a portion of irradiating light by the light receiving face 74 for the overhead sign.

According to the third exemplary embodiment, the reflector 225 includes the reflecting face 225*a* substantially in a shape of an ellipsoid constituting a center axis by the lens center axis Ax passing the light source 123*a*.

According to the reflecting face 225*a*, a sectional shape including the lens center axis Ax is set to substantially an ellipsoid constituting a first focal point by a center position of the light source 123*a* and constituting a second focal point by a vicinity of the rear side focal point F of the projector lens 11 for condensing and reflecting light from the light source 123*a* to the front side to be proximate to the lens center axis Ax.

The shade mechanism 69 is constituted by the first fixed shade 72 arranged between the projector lens 11 and the light source 123*a* such that an upper end edge 72*a* is disposed at a vicinity of the lens center axis Ax at a vicinity of the rear side focal point F of the projector lens 11 for forming a cutoff line of a light distribution pattern by blocking a portion of reflected light from the reflector 225 and a portion of direct light from the light source 123*a*, and a second fixed shade 232 arranged at an inner space of a holder 231 in a cylindrical shape connecting the reflector 225 and the projector lens 11.

The second fixed shade 232 is a shade for preventing stray light reflected by the reflector 225 from being incident on the projector lens 11 and is formed integrally with the holder 231.

In the case of the third exemplary embodiment, the reflecting face 225*b* for the overhead sign is formed integrally with the reflector 225 to be smoothly continuous to a front end portion of the reflecting face 225*a* of the reflector 225.

The light receiving face 74 for the overhead sign is provided by reflecting means 76 made by a metal plate fixed to a side of a front face of the first fixed shade 72.

As shown by FIG. 11, the reflecting means 76 includes a connecting plate portion 76*a* fixed to the side of the front face of the first fixed shade 72 by spot welding or fastening by a rivet, and an inclined face portion 76*b* which is extended from an upper end of the connecting plate portion 76*a* in a skewed lower direction in the front side and a front face of which constitutes the light receiving face 74 for the overhead sign.

A characteristic of the third exemplary embodiment resides in a point that a portion of the inclined face portion 76*b* for providing the light receiving face 74 for the overhead sign is formed with an opening portion 77 by cutting to raise the portion, and the opening portion 77 is utilized as the illuminance reducer 75. Further, the characteristic resides in a point that a front end 78*a* of a cut-to-raise piece 78 constituted by being cut to raise when the opening portion 77 is formed is disposed at a vicinity of the upper end edge 72*a* of the first fixed shade 72.

According to the constitution, light P1 incident on the opening portion 77 formed by being cut to raise is not reflected to the side of the projector lens 11. Therefore, at a position in correspondence with the opening portion 77 on the light distribution pattern by reflected light at the light receiving face 74 for the overhead sign, a light amount is reduced, a dark portion having an illuminance lower than that of the surrounding is constituted, and there can be provided ideal overhead sign irradiating light for forming a dark portion having an illuminance lower than that of the surrounding at a portion in the light distribution pattern in conformity with a countermeasure against glare of a vehicle running on an opposed lane or laws or regulations or the like.

Further, the front end 78*a* of the cut-to-raise piece 78 disposed at the vicinity of the upper end of the movable shade 30 can form the dark portion the illuminance of which is lower than that of the surrounding (illuminance reducing region) at a corresponding position of the light distribution pattern on the road face by blocking a portion of original distributed light passing the upper end edge 30*a*of the movable shade 30 for irradiating the road face.

Therefore, not only the dark portion having the illuminance lower than that of the surrounding is formed by the illuminance reducer 75 at an arbitrary position in the light distribution pattern PX by overhead sign irradiating light P2, but also a portion of the light distribution pattern by light irradiating the road face can be formed with the dark portion smoothly reducing the illuminance. Therefore, a higher degree of a light distribution pattern in conformity with the countermeasure against glare of the vehicle running on the opposed lane or laws or regulations or the like is easily formed.

Further, constitutions of the lamp body, the cover, the projector lens, the light source, the reflector, the shade mechanism, the reflecting face for the overhead sign, the light receiving face for the overhead sign, the illuminance reducer and the additional illuminance reducer and the like according to the vehicle headlamp of the invention are not limited to the above-described constitutions of the exemplary embodiments but various modes thereof can naturally be adopted based on the gist of the invention.

DESCRIPTION OF REFERENCE NUMERALS AND SIGNS

10 . . . vehicle headlamp
11 . . . projector lens
12 . . . lamp body
14 . . . transparent cover (cover)
16 . . . lamp chamber
18 . . . lamp unit
23 . . . light source bulb
23*a* . . . light source
25 . . . reflector
25*a* . . . reflecting face
25*b* . . . reflecting face for overhead sign
28*a* . . . light receiving face for overhead sign
29 . . . shade mechanism
30 . . . movable shade
31 . . . holder
44 . . . cam plate
51, 52 . . . illuminance reducer
54, 55 . . . dark portions
66 . . . swivel actuator
P1 . . . reflected light
P2 . . . overhead sign irradiating light
PL . . . light distribution pattern for low beam
PX . . . OHS light distribution pattern While the invention has been described with reference to the exemplary embodiments and variations thereof, the technical scope of the invention is not restricted to the description of the exemplary embodiments and variations thereof. It is apparent to the skilled in the art that various changes or improvements can be made. It is apparent from the description of claims that the changed or improved configurations can also be included in the technical scope of the invention.

What is claimed is:

1. A vehicle headlamp comprising:

a projector lens arranged on an optical axis extended in a front and rear direction of a vehicle;

a light source arranged rearward from a rear side focal point of the projector lens;

a reflector for reflecting direct light from the light source to a front side to be proximate to the optical axis;

a shade arranged between the projector lens and the light source for forming a cutoff line of a light distribution pattern by blocking a portion of reflected light from the reflector and a portion of the direct light from the light source;

a reflecting face, for illuminating an overhead sign, said reflecting face being provided on an upper side of the light source for reflecting light from the light source;

a light receiving face provided frontward of the shade for reflecting light from the reflecting face to the projector lens so as to emit irradiating light in an upward direction from the projector lens; and an illuminance reducer for reducing a portion of irradiating light by the light receiving face, wherein the illuminance reducer is provided on the light receiving face and in a position of a vicinity of an upper end of the shade.

2. The vehicle headlamp according to claim 1, wherein the illuminance reducer comprises a notch portion constituted by cutting a surface of the light receiving face in a shape of a cylindrical face, and wherein light reflected by the light receiving face includes a dark portion corresponding to the notch portion.

3. The vehicle headlamp according to claim 1, wherein the illuminance reducer comprises a low reflecting portion of the surface of the light receiving face, wherein the low reflecting portion has a reflectance lower than a reflectance of other portions of the surface of the light receiving face.

4. The vehicle headlamp according to claim 1, wherein the illuminance reducer comprises an opening portion constituted by cutting to raise the surface of the light receiving face, and a front end of a cut-to-raise piece that is cut and raised is disposed at the vicinity of the upper end of the shade.

5. The vehicle headlamp according to claim 1, further comprising:

an additional illuminance reducer for reducing a portion of irradiating light by the light receiving face, wherein the additional illuminance reducer is provided on a portion of the light receiving face positioned on a lower side of the illuminance reducer.

6. The vehicle headlamp according to claim 1, wherein the projector lens, the light source, the reflector, and the shade are arranged at inside of a lamp chamber formed by a lamp body and a cover.

7. The vehicle headlamp according to claim 5, further comprising:

a swivel actuator; and a failsafe mechanism, when a failsafe operation of the failsafe mechanism is carried out, the additional illuminance reducer reduces the portion of irradiating light by the light receiving face.

8. The vehicle headlamp according to claim 1, wherein the reflecting face has substantially ellipsoidal sectional shape.

9. The vehicle headlamp according to claim 1, wherein the light receiving face is provided on a front face of the shade.

10. The vehicle headlamp according to claim 1, wherein the reflecting face comprises an ellipsoidal shape with a first focal point on the light source and a second focal point, and wherein the light receiving face comprises a shape of a paraboloid of revolution having a focal point on said second focal point.

* * * * *